United States Patent [19]

Yamaoka et al.

[11] Patent Number: 4,881,670

[45] Date of Patent: Nov. 21, 1989

[54] AUTOMATIC MELT SUPPLYING METHOD AND HOLDING FURNACE HAVING AUTOMATIC MELT SUPPLYING SYSTEM

[75] Inventors: Masao Yamaoka; Tomohiro Toyota, both of Yao, Japan

[73] Assignee: Kabushiki Kaisha Daiki Aluminium Kogyosho, Osaka, Japan

[21] Appl. No.: 246,570

[22] Filed: Sep. 13, 1988

[30] Foreign Application Priority Data

Jul. 1, 1988 [JP] Japan ..... 63-164257

[51] Int. Cl.[4] ..... C21C 5/42

[52] U.S. Cl. ..... 222/590; 266/239

[58] Field of Search ..... 222/590, 596, 595; 266/236, 212, 216, 206, 239

[56] References Cited

U.S. PATENT DOCUMENTS 3,128,327 4/1964 Upton ..... 222/596

4,078,706 3/1978 Hanuszczak ..... 222/596

4,428,413 1/1984 Lester ..... 222/596

FOREIGN PATENT DOCUMENTS 0541088 1/1977 U.S.S.R. ..... 222/596

*Primary Examiner*—S. Kastler

*Attorney, Agent, or Firm*—Edwin E. Greigg

[57] ABSTRACT

A holding furnace with an automatic melt supplying system comprising a holding chamber for holding a melt at a predetermined temperature, a treating chamber for cleaning the melt, and a melt supplying chamber connected for supplying the melt to a subsequent process. A plug is mounted in an opening intercommunicating the treating chamber and the melt supplying chamber. A force block vertically movably mounted in the melt supplying chamber, the force block being submerged in the melt stored in the melt supplying chamber to supply the melt to the subsequent process when the plug is in a closed position.

14 Claims, 2 Drawing Sheets

AUTOMATIC MELT SUPPLYING METHOD AND HOLDING FURNACE HAVING AUTOMATIC MELT SUPPLYING SYSTEM

BACKGROUND OF THE INVENTION

1. Field of the Invention

The present invention relates to an automatic melt supplying method and a holding furnace having an automatc melt supplying system which, though simple, are capable of accurate melt supply under a severe, high-temperature condition.

2. Description of the Prior Art

The holding furnace generally comprises a holding chamber, and a melt supplying chamber communicating with the holding chamber. The holding chamber receives molten aluminum or various other non-ferrous metals through a melt inlet, and maintains the melt at a predetermined temperature by use of a heater or a burner. The melt supplying chamber is connected to a casting machine, and supplies a fixed amount of molten non-ferrous metal for every casting operation.

In the conventional holding furnace, the holding chamber is constructed fluid-tight and includes various sensors. This holding chamber is pressurized to cause the fixed amount of melt to be supplied from the melt supplying chamber to the casting machine. Such a complicated construction is placed under an extremely high temperature condition and perfect fluid-tightness cannot be assured, which make the holding furnace difficult to control in a satisfactory manner. This results in a low melt supplying precision and is a primary cause of casting machine malfunctioning and defective products.

Such a pressurization/non-pressurization switching mode requires a compressor, sensors, control devices, and a separate melt supplying machine which takes up a large space. Further, when the melt is supplied under pressure, the melt surface becomes ruffled to a great extent thereby entraining oxides in an increased amount and impairing product quality. Where the melt is scooped with ladles, coating materials fall from the ladles into the melt to add impurities to the melt. Thus, the conventional holding furnace has various drawbacks.

SUMMARY OF THE INVENTION

The present invention has been made having regard to the disadvantages of the prior art noted above, and an object is to provide an automatic melt supplying method and a holding furnace having an automatic melt supplying system which are novel and simple, and necessitate only a compact construction for accurately supplying melt at all times.

In order to achieve the above object, an automatic melt supplying method according to the present invention comprises the steps of allowing a melt intended for use in a subsequent process to flow into a melt supplying chamber and to reach a selected level in the melt supplying chamber, and submerging a force block to a selected depth of the melt in the melt supplying chamber, thereby causing the melt to overflow from the melt supplying chamber in an amount corresponding to a submerged volume of the force block and to be supplied for the subsequent process.

A holding furnace having an automatic melt supplying system according to the present invention comprises a holding chamber for holding a melt at a predetermined temperature,a melt supplying chamber connected to the holding chamber through a stopper plug, for supplying the melt to a subsequent process, and a force block vertically movably mounted in the melt supplying chamber, the force block being submerged in the melt stored in the melt supplying chamber to supply the melt to the subsequent process when the plug is in a closed position.

According to the above method and construction, a predetermined amount of melt overflows from the melt supplying chamber to be supplied to the subsequent process in an accurate manner simply by closing the stopper plug and lowering the force block to a selected depth in the melt stored in the melt supplying chamber. This feature allows the melt supplying system to be very compact. Consequently, the holding furnace according to the present invention may be manufactured at half to one third of the cost of a melt supplying machine used for die casting, for example. The compact construction as noted above allows the melt supplying chamber to be incorporated into the holding furnace as an integral part thereof, as distinct from the prior art wherein the melt supplying machine and the holding furnace are formed as separate entities. This feature of the invention provides the advantage of necessitating only a small space for furnace installation. Moreover, since only a small amount of melt is directly involved at a time of melt supplying operation, the melt is supplied in an orderly manner without becoming ruffled to entrain oxides as in the prior art. This feature also helps in maintaining a clean melt supply. In addition, the furnace according to this invention which is very simple in construction has no possibility of malfunctioning in spite of use under a severe condition, i.e. at extremely high temperatures. Since the amount of melt supply is determined simply by submergence of the force block, it is always accurate without being influenced by operating conditions, which has the advantage of eliminating all of the various inconveniences due to errors in the amount of melt supply. Further, since only the force block is submerged in the melt and ladles are not used as in the known furnace, there occurs no mixing into the melt of coating materials on the ladles, whereby the melt is supplied in a very clean state.

Other advantages of the present invention will be apparent from the following description of the preferred embodiments to be had with reference to the drawings.

DETAILED DESCRIPTION OF THE PREFERRED EMBODIMENTS

Figure 1:
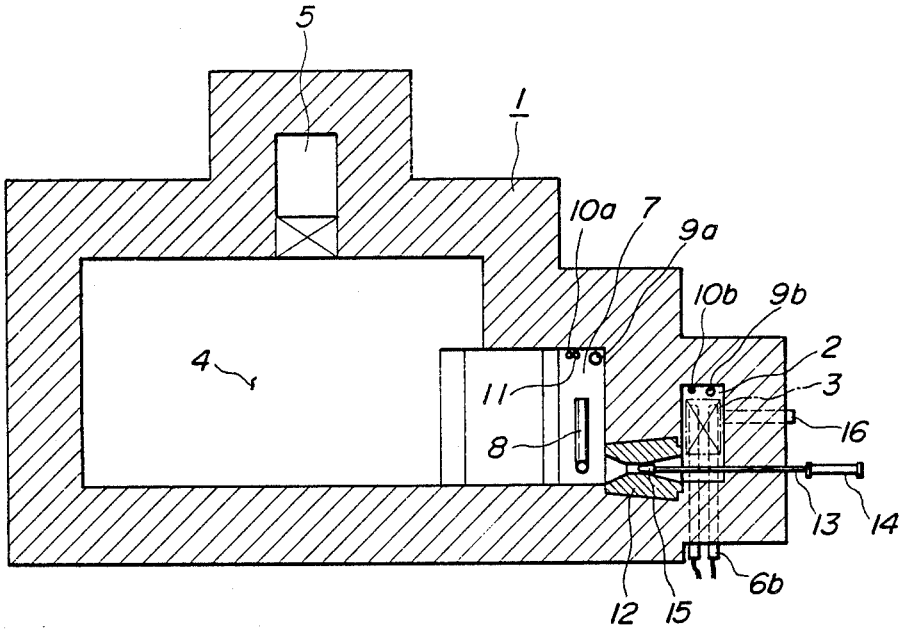
FIG. 1 is a view in cross section of a holding furnace according to a first embodiment of the present invention.
Figure 2:
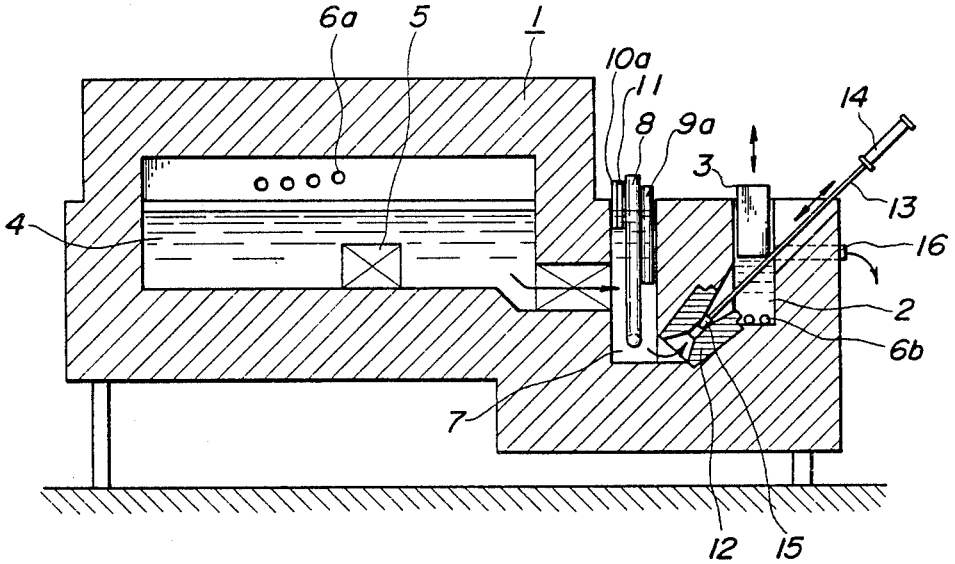
FIG. 2 is a view in vertical section of the holding furnace.

A first embodiment of the invention will be described with reference to FIGS. 1 and 2. The holding furnace 1 shown therein comprises a holding chamber 4 holding a melt at a predetermined temperature, and a melt supplying chamber 2 for supplying the melt to a subsequent process. The holding chamber 4 includes a melt inlet 5 for receiving the melt, and a heater 6a for maintainng the melt at the predetermined temperature. the holding furnace further comprises a treating chamber 7 disposed at an outlet end of the holding chamber 4 and including a porous lance 8, a thermocouple 9a, and two, upper and lower limit level sensors 10a and 11, all submerged in the melt. Thus, controls are provided for the melt level and temperature, and inert gas is injected into the melt for causing hydrogen and other gases to be released from the melt, thereby to supply clean melt not containing oxides or the like to the melt supplying chamber 2. The treating chamber 7 and the melt supplying chamber 2 are interconnected through a melt outlet 12 which is openable to supply the clean melt to the melt supplying chamber 2. As seen from the drawings, the melt outlet 12 is constricted toward an intermediate position thereof to define a center throat, and a stopper plug 13 in rod form extends into the melt outlet 12 with a head 15 thereof movable into and out of contact with the center throat to open and close the melt outlet 12. The stopper plug 13 extends downwardly from the melt supplying chamber 2 toward the treating chamber 7, and is driven by a cylinder 14. The melt supplying chamber 2 includes an upper limit level sensor 10b, a melt temperature controlling thermocouple 9b, both submerged in the melt, and a heater 6b at the bottom thereof for maintaining the melt temperature at a predetermined level in the melt supplying chamber 2. Further, the melt supplying chamber 2 includes a force block 3 vertically movably mounted in an upper position thereof, and is connected through a melt supplying conduit 16 to a next process, for example, a casting machine.

The melt is supplied through the melt inlet 5 of the holding chamber 4 when the melt surface lowers below the lower limit level sensor 11 in the holding chamber 4, and the melt supply is stopped when the melt surface reaches the upper limit level sensor 11. Thus, the melt surface is controlled between the upper and lower limit level sensors 10a and 11. At the same time the thermocouple 9a detects the melt surface in the treating chamber 7, and the heater 6a maintains the melt stored in the holding chamber 4 substantially at the predetermined temperature before and after the melt supply. In the treating chamber 7, hydrogen and other gases are released and oxides and other impurities are removed from the melt by injecting inert gas into the melt as noted hereinbefore, thereby enabling a clean melt supply. For supplying the melt to the casting machine, the stopper plug 13 is opened first to introduce the clean melt from the treating chamber 7 to the melt supplying chamber 2, and the plug 13 is closed when the upper limit level sensor **10*b* detects the melt, whereby the melt supplying chamber 2 is filled with a predetermined amount of melt. Thereafter the force block 3 is lowered to a selected depth of the melt. Then the melt overflows into the conduit 16 in an amount corresponding to a submerged volume of the force block 3, whereby the casting machine receives a selected amount of melt. The melt supply is adjustable as desired by varying the diameter and the depth of submergence of the force block 3. Meanwhile, the melt temperature in the melt supplying chamber 2 is controlled by the thermocouple 9*b* and the heater 6*b*. When the melt supply is completed, the force block 3 is raised from the melt and the melt surface lowers to an extent corresponding to the amount of melt forced from the melt supply chamber 2. Then the stopper plug 13 is actuated to open the melt oulet 12 to introduce the melt from the treating chamber 7**. The above operation is repeated therafter.

Thus, the described holding furnace functions as follows:

(1) The melt is supplied to the holding chamber 4 and is maintained at a predetermined temperature.

(2) The stopper plug 13 is opened to allow the melt to flow in a selected amount from the holding chamber to the melt supplying chamber 2.

(3) Thereafter the stopper plug 13 is closed and the force block or float 3 is submerged to a predetermined depth in the melt stored in the melt supplying chamber 2.

(4) The melt overflows from the melt supplying chamber 2 in an amount corresponding to the submerged volume of the force block 3, to be supplied to a next process such as a casting machine.

(5) Upon completion of the melt supply, the force block 3 is raised from the melt, and the operation is repeated from the step (2) above.

Figure 3:
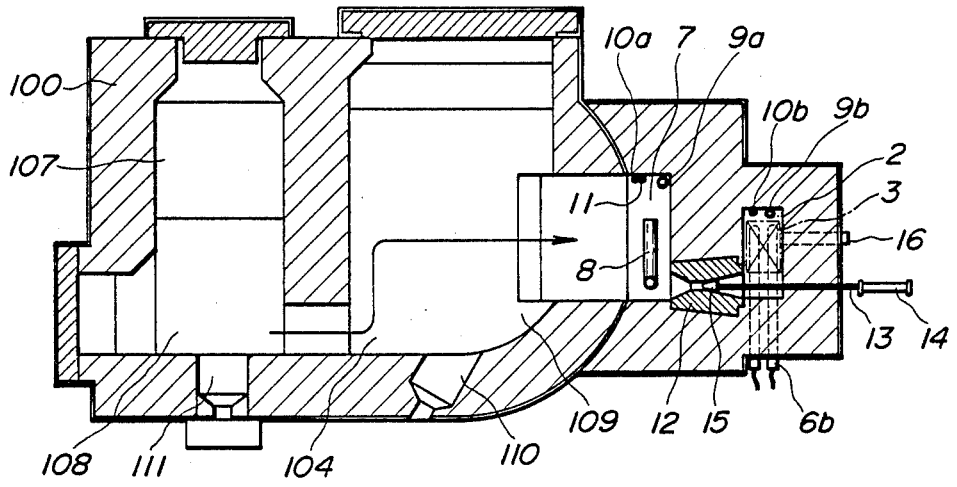
FIG. 3 is a view in cross section of a holding furnace according to a second embodiment of the invention.
Figure 4:
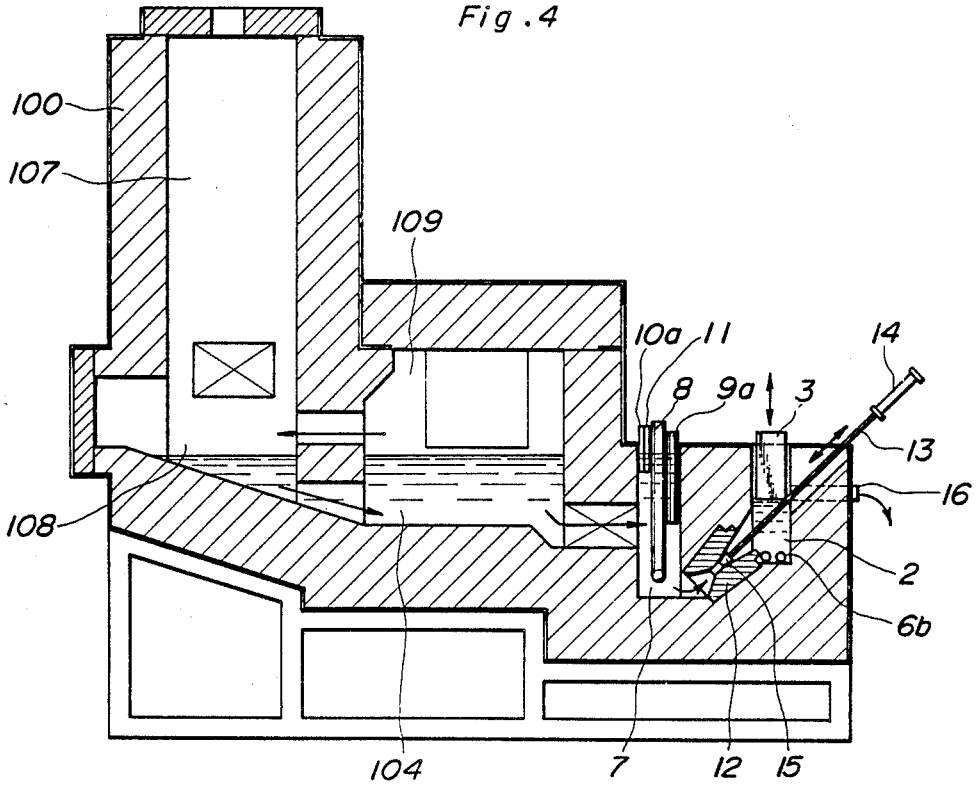
FIG. 4 is a view in vertical section of the holding furnace shown in FIG. 3.

A second embodiment of the invention will be described next with reference to FIGS. 3 and 4. In this embodiment, the present invention is applied to a holding furnace which employs a burner as distinct from the first embodiment. The illustrated furnace 100 comprises a preheating tower 107, a melting chamber 108 continuous with the bottom of preheating tower 107, a holding chamber 109 communicating at its bottom with the melting chamber 108, and a well 104 communicating at its bottom with the holding chamber 109. The holding chamber 109 has a sustaining burner 110 for producing a flame at an angle to the holding chamber 109, so that the flame moves round in the holding chamber 109 and flows into the melting chamber 108. The melting chamber 108 includes a melting burner 111 for producing a flame straight into the melting chamber 108.

This embodiment employs basically the same automatic melt supplying system as in the first embodiment. the outline of the system will be set out hereunder.

The holding chamber 109 includes a melt inlet for receiving the melt, and a heater for maintaining the melt at a predetermined temperature. A treating chamber is disposed at an outlet end of the holding chamber 109, which includes a porous lance, a thermocouple, and two, upper and lower limit level sensors, all submerged in the melt. Thus, controls are provided for the melt level and temperature, and inert gas is injected into the melt for causing hydrogen and other gases to be released from the melt, thereby to supply clean melt not containing oxides or the like to the well. The treating chamber and the well are interconnected through a melt outlet which is openable to supply the clean melt to the well. The melt outlet is constricted toward an intermediate position thereof to define a center throat, and a stopper plug in rod form extends into the melt outlet with a head thereof movable into and out of contact with the center throat to open and close the melt outlet. The stopper plug extends downwardly from the well toward the treating chamber, and is driven by a cylinder. The melt well includes an upper limit level sensor, a melt temperature controlling thermocouple, both submerged in the melt, and a heater at the bottom thereof for maintaining the melt temperature at a predetermined level in the well. Further, the well includes a force block vertically movably mounted in an upper position thereof, and is connected through a melt supplying conduit to a next process, for example, a casting machine.

What is claimed is:

1. A method for automatically supplying a melt to a casting device, comprising;

supplying a melt to a holding chamber for holding said melt at a predetermined temperature, supplying said melt in said holding chamber to a melt supply chamber via an opening between said holding chamber and said supply chamber, controlling a stopper plug for opening and closing said opening to control a melt flow from said holding chamber to said supply chamber, and lowering a vertically movable force block into said supply chamber to displace and force a predetermined amount of melt from said supply chamber to said casting device.

2. A method as claimed in claim 1, which includes detecting an amount of melt in said supply chamber to limit said melt to a predetermined amount within said supply chamber.

3. A method as claimed in claim 2, which includes heating said melt to maintain said melt at a predetermined temperature in said holding chamber and said supply chamber.

4. A method as claimed in claim 3, which includes melting desired materials prior to admitting said melt into said holding chamber.

5. A holding furnace having an automatic melt supplying system, comprising;

a holding chamber for holding a melt at a predetermined temperature, a melt supply chamber, a melt outlet disposed between said holding chamber and said melt supply chamber, a movable stopper plug operable to open and close said melt outlet for supplying the melt to said melt supply chamber, means for actuating said movable stopper plug, and a vertically movable force block mounted in said melt supply chamber, said force block being movable to a submerged position in a melt stored in the melt supply chamber to supply a portion of the melt to a subsequent work station when the plug is in a closed position.

6. A holding furnace as claimed in claim 4, further comprising a treating chamber provided between the holding chamber and the melt supply chamber, and a porous lance provided in the treating chamber for injecting inert gas into the melt in the treating chamber.

7. A holding furnace as claimed in claim 6, further comprising a level sensor disposed in the treating chamber for controlling a level of the melt.

8. A holding furnace as claimed in claim 7, further comprising a thermocouple disposed in the treating chamber for controlling a temperature of the melt.

9. A holding furnace as claimed in claim 4, further comprising a level sensor disposed in the melt supply chamber for controlling a level of the melt, a thermocouple disposed in the melt supply chamber for controlling a temperature of the melt, and a heater disposed in a bottom of the melt supply chamber.

10. A holding furnace as claimed in claim 4, which includes a heater in said supply chamber for maintaining the temperature of the melt in the supply chamber at a desired temperature.

11. A holding furnace as claimed in claim 10, which includes a heater in said holding chamber for maintaing the temperature of the melt in the holding chamber at a desired temperature.

12. A holding furnace as claimed in claim 4, which includes preheating and melting chamber which supplies the melt to said holding chamber.

13. A holding furnace as claimed in claim 10, which includes preheating and melting chamber which supplies the melt to said holding chamber.

14. A holding furnace as claimed in claim 11, which includes preheating and melting chamber which supplies the melt to said holding chamber.

* * * * *